United States Patent [19]

Lin

[11] Patent Number: 4,557,467

[45] Date of Patent: Dec. 10, 1985

[54] ELBOW OF STAIRCASE HAND RAIL

[76] Inventor: Ta C. Lin, 8, 4 La., Pei Jung St., Jen Wu Li, Chiayi City, Taiwan

[21] Appl. No.: 640,692

[22] Filed: Aug. 14, 1984

[51] Int. Cl.[4] ..... E04H 17/14

[52] U.S. Cl. ..... 256/59; 256/1; 403/292

[58] Field of Search ..... 256/59, 65, 1; 403/292, 403/306

[56] References Cited

U.S. PATENT DOCUMENTS

| | | | |
|---|---|---|---|
| 2,746,769 | 5/1956 | Hoogendoorn | 403/292 X |
| 2,878,059 | 3/1959 | Limle | 403/292 X |
| 3,333,823 | 8/1967 | Genauer et al. | 256/65 |
| 4,353,661 | 10/1982 | Ruther | 403/292 X |

FOREIGN PATENT DOCUMENTS

| | | | |
|---|---|---|---|
| 1429581 | 1/1966 | France | 256/65 |
| 9329 | of 1884 | United Kingdom | 403/292 |
| 511190 | 8/1939 | United Kingdom | 403/292 |

*Primary Examiner*—Andrew V. Kundrat

[57] ABSTRACT

An improved design of an elbow for a staircase hand rail wherein a specially designed intermediate bearer is used to join the elbow terminal of two adjoining, separately provided hand rails.

4 Claims, 6 Drawing Figures

ELBOW OF STAIRCASE HAND RAIL

BACKGROUND OF THE INVENTION

The present invention provides for an improved stairway hand rail, more particularly for a specially devised intermediate means to join the elbow terminal of two adjoining hand rail sections in a manner that is more efficient, economical and reliable than conventional means.

It is common practice to bend the portion of a stairway hand rail where a turn is made into an N formation with a slope and run that gives the entire hand rail a look of continuity and that provides protection for people walking up and down the stairs. In construction, a hand rail is usually installed on a stairway terrace with the N shaped intersection formed by elbows extending from either end of the rail sections and connected by means of joining members. These members are frequently prefabricated wooden pieces shaped by a tooling process that takes into account the slope of the full length of the hand rail including the elbow joints as determined by computation prior to working. Unfortunately, possible deviations may occur during the joiner's work which will result in a useless piece and possibly a number of pieces that fails to serve the purpose of forming the desired N shaped configuration. In addition, the labor and time consumed in joining two elbow ends together in such a conventional way incur costs beyond the economic capacity of common consumers, and are all the more unacceptable in that the conventional way fails to provide the desired aesthetically beautiful look to the stairway.

In view of the foregoing, the inventor herein has engaged in designing improvements to the elbow sections of stairway hand rails.

SUMMARY OF THE INVENTION

The primary object of this invention is to provide a new, highly effective structural design for the elbow section of stairway hand rails.

A further object is to provide an improved elbow for stairway hand rails that is simple in consturction, economic in production costs, free from scrap waste and desirable for use.

Still another object of the present invention is to provide an improved design for the elbow of stairway hand rails suitable for mass production, thereby enhancing productivity and lowering production costs, and with auxiliary aesthetic or decorative effects realized upon finishing.

Other features and advantages of the present invention will emerge from the following descriptions of embodiments given by way of illustration but not in any way limiting the scope thereof.

DETAILED DESCRIPTION OF THE INVENTION

Figure 1:
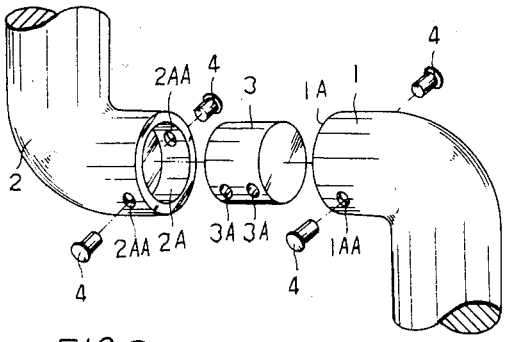
FIG. 1 is an exploded, three-dimensional perspective view of a first embodiment of the improved stairway hand rail elbow.

Referring to FIG. 1, it will be seen that the invention in the first embodiment comprises hand rails 1 and 2 and plug 3. Hand rails 1 and 2 are each provided with a pair of apertures 1AA and 2AA in the L shaped terminal thereof, and with hollows 1A and 2A within which the plug 3 is placed so that hand rails 1 and 2 will abut each other upon engagement. In the plug 3 there are provided recesses 3A to cooperate with apertures 1AA and 2AA upon connection of hand rails 1 and 2, the intent being that hand rails 1 and 2 will be allowed a 360 degree rotative adjustment about the plug 3 in answer to a given angle of deflection of stairway 5. The connection is secured by having fasteners 4 penetrating into recesses 3A by way of aperatures 1AA and 2AA as provided in the hand rails 1 and 2. Of course the recesses 3A in the plug 3 will not be drilled until the specific angular positions of the hand rails 1 and 2 have been determined. Fasteners 4 can be screws or other equivalent items.

Figure 2:
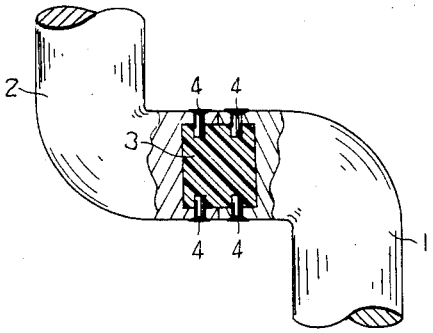
FIG. 2 is a cut-away cross-section of the improved stairway hand rail elbow shown in FIG. 1.
Figure 3:
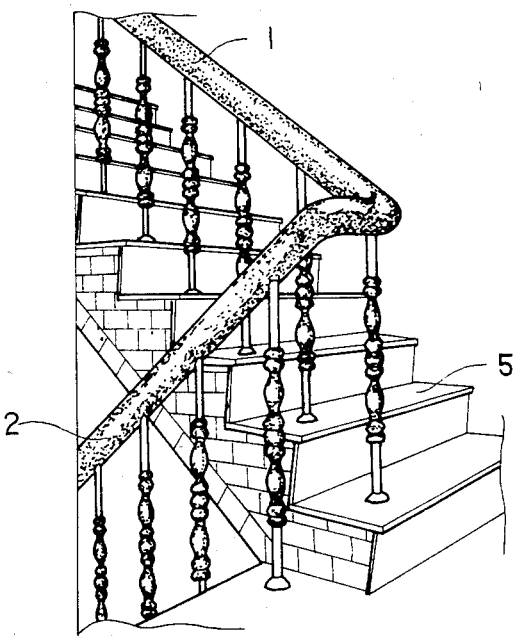
FIG. 3 is an illustration of the inventive design installed on the terrace of a stairway.

Reference to FIG. 2 and FIG. 3 further illustrates the invention herein substantiated in a stairway in cut-away cross-section and overall perspective setting. FIG. 3 particularly stands for a simple structured, easy to install, beautifully profiled, labor and time saving hand rail permitting mass production with common machinery at extremely economical production costs. In addition, elbow joints made according to this invention can be shipped in sections to achieve optimum space saving and transit fares, unlike conventional rails that may all too easily turn to waste or scrap by even minimum deviation from tolerances. Conventional rails are not as desirable in terms of subservience to decorative effects, indoors or outdoors; the instant invention, in sharp contrast, will meet requirements in any stairway application by means of its resilient matching that is a breakthrough in the service of elbows of hand rails installed to complement a stairway anywhere.

Figure 4:
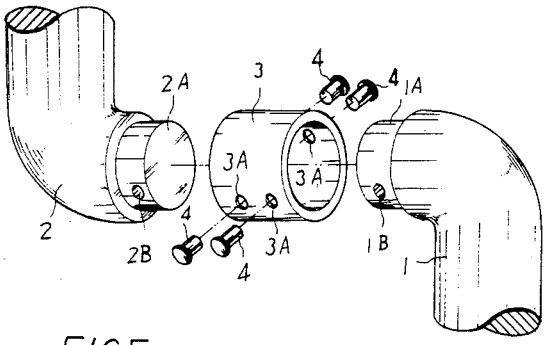
FIG. 4 is an exploded, three-dimensional perspective view of a second embodiment of the improved stairway hand rail elbow.

To provide yet a better understanding of the invention, another embodiment is presented as a further illustrative example. As shown in FIG. 4 this embodiment consists of two hand rails 1 and 2 and a sleeve 3 serving in the capacity of an intermediate means. Hand rails 1 and 2 are provided with areas of smaller diameter 1A and 2A at their abutting ends to facilitate coupling of the L shape terminal. Sleeve 3, fitting over the areas of smaller diameter 1A and 2A and being flush with the rest of hand rails 1 and 2, secures the elbow in position. Apertures 3A in the sleeve 3 and recesses 1B and 2B in the smaller diameter areas receive fasteners 4 to couple sleeve 3 to the hand rails 1 and 2.

Figure 5:
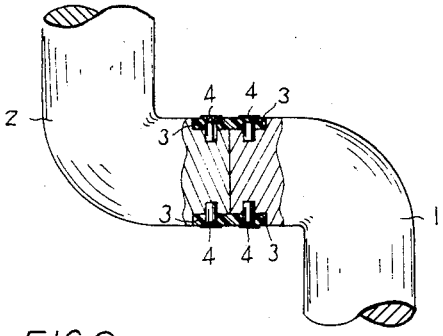
FIG. 5 is a cut-away cross-section of the improved stairway hand rail elbow shown in FIG. 4.
Figure 6:
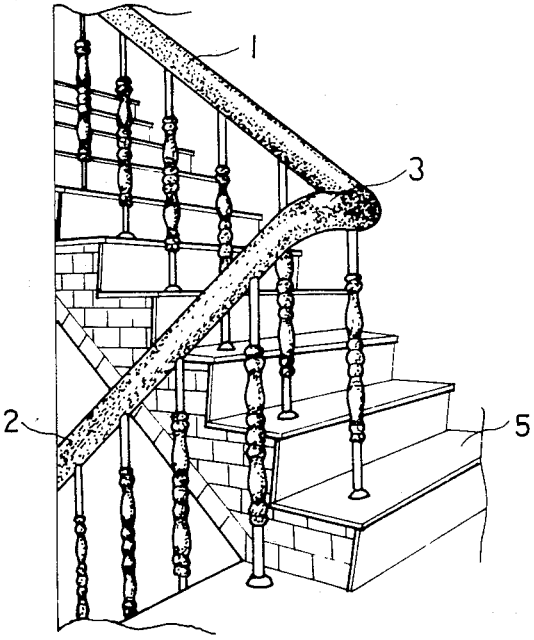
FIG. 6 is a three-dimensional perspective view of an improved stairway hand rail elbow installed on a stairway terrace substantially according to the invention.

Reference to FIG. 5 and FIG. 6 shows a cut-away and cross-sectional view of this embodiment and a perspective of a complete railing on the background of a stairway terrace in which it is evident that the areas of smaller diameter 1A and 2A of each hand rail 1 and 2 are inserted into apertures 3A to realize mutual coupling with recesses 1B and 2B provided in the areas of reduced diameter 1A and 2A. Drilling of recesses 1B and 2B will, of course, not take place until the hand rails 1 and 2 have been positioned at suitable angles. The type of fastener 4 can be chosen according to actual requirements of design and performance priorities. The advantages are similar to those recited for the first embodiment and do not need repeating.

The two embodiments given in the foregoing disclosure serve as an illustration of the invention and are by no means limiting since modifications and variations of the invention, upon an understanding of the disclosure, will become apparent to those skilled in the art.

I claim:

1. An improved elbow of a stairway hand rail comprising two L-shaped hand rail sections, an intermediate means and a plurality of fasteners, characterized in that each of said two L-shaped hand rail sections is terminated with a hollow of smaller diameter and said sections will be united by said intermediate means encompassed within said hollows, and that a pair of symmetrical apertures are provided in said sections in the area of said hollows to cooperate with recesses in said intermediate means to receive said fasteners to secure the resulting elbow.

2. An improved elbow of a stairway hand rail as in claim 1 wherein said intermediate means is a plug inserted into said hollows and said L-shaped sections are rotatably adjustable through 360 degrees, said recesses in said plug being drilled only after the specific angular positions of said L-shaped sections have been determined.

3. An improved elbow of a stairway hand rail comprising two L-shaped hand rail sections, an intermediate means and a plurality of fasteners characterized in that each of said two L-shaped hand rail sections is terminated with a portion of reduced diameter extending from the end thereof, said portions having symmetrically disposed recesses, said intermediate means being a sleeve to fit over said portions and having apertures to cooperate with said recesses to receive said fasteners to secure the resulting elbow.

4. An improved elbow of a stairway hand rail as in claim 3 wherein said L-shaped sections are rotatably adjustable through 360 degrees and said recesses in said portions of reduced diameter are drilled only after said L-shaped sections have been properly positioned.

* * * * *